US007540052B2

(12) United States Patent
van der Meijden et al.

(10) Patent No.: US 7,540,052 B2
(45) Date of Patent: Jun. 2, 2009

(54) CLEANING OF A SUBMERGED SURFACE

(75) Inventors: Hendrikus Johannes van der Meijden, Halfway House (ZA); Michael Edward Moore, Westdene (ZA)

(73) Assignee: Zodiac Pool Care, Inc., Vista, CA (US)

( * ) Notice: Subject to any disclaimer, the term of this patent is extended or adjusted under 35 U.S.C. 154(b) by 897 days.

(21) Appl. No.: 10/483,371

(22) PCT Filed: Jul. 10, 2002

(86) PCT No.: PCT/IB02/02691

§ 371 (c)(1),
(2), (4) Date: Jun. 10, 2004

(87) PCT Pub. No.: WO03/012227

PCT Pub. Date: Feb. 13, 2003

(65) Prior Publication Data

US 2004/0216251 A1 Nov. 4, 2004

(30) Foreign Application Priority Data

Jul. 11, 2001 (ZA) ..... 01/5701
Sep. 21, 2001 (ZA) ..... 01/7826

(51) Int. Cl.
*E04H 4/16* (2006.01)

(52) U.S. Cl. ..... 15/1.7; 210/169

(58) Field of Classification Search ..... 15/1.7, 15/347, 246, 246.5; 134/111, 167 R, 624.14; 210/169, 111; 4/490
See application file for complete search history.

(56) References Cited

U.S. PATENT DOCUMENTS

| | | | | |
|---|---|---|---|---|
| 3,972,339 | A | 8/1976 | Henkin et al. | |
| 4,651,376 | A | 3/1987 | Ford | |
| 4,749,478 | A | 6/1988 | Brooks | |
| 4,768,532 | A * | 9/1988 | Johnson | 134/111 |
| 4,835,809 | A * | 6/1989 | Roumagnac | 15/1.7 |
| 6,473,928 | B1 * | 11/2002 | Veloskey et al. | 15/1.7 |
| 7,039,980 | B2 * | 5/2006 | Van Der Meyden et al. | 15/1.7 |
| 2002/0170129 | A1 * | 11/2002 | Veloskey et al. | 15/1.7 |
| 2004/0216251 | A1 * | 11/2004 | Van Der Meijden et al. | 15/1.7 |
| 2004/0255407 | A1 * | 12/2004 | Van Der Meijden et al. | 15/1.7 |

FOREIGN PATENT DOCUMENTS

WO WO99/61727 12/1999

* cited by examiner

*Primary Examiner*—Lee D Wilson
(74) *Attorney, Agent, or Firm*—Dean W. Russell; Kilpatrick Stockton LLP

(57) ABSTRACT

A pressure type pool cleaner includes a head propelled forwardly over a surface. Water pumped to the head drives wheels turbine fashion; inducts debris into a cleaner system; and is ejected via a thrust nozzle onto a guide and thence along a thrust line to thrust the head along the line. A pivoted director mounts the guide and includes a surface member exposed to the water. During forward movement, water pressure on the member counteracts jet stream pressure on the guide and maintains the guide's orientation for the thrust line to pass closely above a wheel rotation axis. When an obstacle stops forward motion, pressure on the member and its counteracting stop, the guide is reoriented and redirects the thrust to well below the axis to pivot the head about the axis to assist the wheels to scale the obstacle.

22 Claims, 5 Drawing Sheets

FIG 1

CLEANING OF A SUBMERGED SURFACE

CROSS REFERENCE TO RELATED APPLICATIONS

This application is the U.S. national phase of International Application No. PCT/IB02/02691 filed on Jul. 10, 2002 and published in English as International Publication No. WO 03/012227 A1 on Feb. 13, 2003, which application claims priority to South African Provisional Application No. 2001/5701 filed on Jul. 11, 2001 and South African Provisional Application No. 2001/7826 filed on Sep. 21, 2001, the contents of which are incorporated by reference herein.

THIS INVENTION relates to cleaning of a submerged surface. It relates more particularly to a method of propelling a pool cleaner, and to a pool cleaner.

The Applicant expects this invention to be applicable particularly advantageously to pool cleaners of the pressure (as opposed to suction) type, and that application will predominantly be borne in mind for purposes of this specification.

For convenience, for purposes of this specification, terms indicating orientation and direction must be interpreted as referring to a situation in which the pool cleaner moves in a normal direction of travel over a horizontal surface.

In pool cleaners of the pressure type, water is pumped under pressure to a submerged cleaning device or pool cleaner head. In the head, energy associated with the pumped flow stream of water is converted to drive the head over a submerged surface of the pool. In one embodiment, the head has one, or preferably a pair of laterally spaced wheels or rollers. Energy obtained from the pumped flow stream of water is converted into mechanical energy associated with torque which is applied to the wheels or rollers to propel the pool cleaner. This is the primary method of propelling the pool cleaner.

It is to be appreciated that, for various reasons which are well understood in the field of submerged pool cleaners, the head has virtually neutral buoyancy in water, the buoyancy being only slightly negative, ie the head has only a very small weight when submerged. Thus, the wheels have only very little grip against generally horizontal surfaces, and have no traction against vertical surfaces.

A secondary method of propelling the head is to redirect a portion of the pumped flow stream appropriately to create a jet stream imparting thrust to the head.

This invention relates to a device in which the primary and secondary methods of driving or propelling the head are combined. The jet stream is directed such that thrust is imparted to the head not only to drive it in its normal direction of motion, but also such as to drive it onto the surface along which it moves. This enhances traction against horizontal surfaces, and provides traction against vertical surfaces.

The Applicant has experienced a problem in the kind of pool cleaner to which this invention relates when the head is obstructed by a wall transverse to a surface along which it is moving. The Applicant has found that, under severe conditions, either the drive wheels stall and stop turning, or they lose traction and slip, either condition causing the head to stop.

A further problem experienced by the Applicant is that in the kind of pool cleaner to which this invention relates, the pool cleaner tends to move in relatively straight lines which can lead to surfaces of the pool not being cleaned.

It is an object of this invention to at least alleviate these problems.

In accordance with a first aspect of this invention, there is provided a method of propelling a pool cleaner of the pressure kind over a submerged surface, the method including pumping water in a flow stream to a pool cleaner head;

converting energy of the pumped flow stream into mechanical energy associated with torque and applying said torque to at least one drive wheel, mounted to the head about a lateral wheel axis, to propel the head in a forward direction;

directing a portion of the pumped flow stream via a thrust nozzle mounted on the head in a jet stream generally along a first jet stream line to generate thrust generally along a first thrust line co-incident with said first jet stream line and in opposite direction;

in response to the head being checked against an obstacle transverse to said submerged surface, redirecting the jet stream along a second jet stream line to redirect thrust along a second thrust line co-incident with said second jet stream line and in opposite direction thereto, such as to cause the head to rotate about said lateral wheel axis relative to the submerged surface.

In a preferred method, the first jet stream line and the first thrust line are oriented to intersect or to pass proximate, most preferably slightly above, the drive wheel axis, and the second jet stream line and the second thrust line are oriented to pass the drive wheel axis remotely on the side of the submerged surface, for example about longitudinally to a periphery of the wheel or to a position on the periphery of the wheel contacting the submerged surface-all when received two-dimensionally in side view-in reality the thrust line passes between the wheels, for example centrally between the wheels when viewed in plan. The second thrust line may pass most preferably proximate an interface between the or each drive wheel and said submerged surface.

The Applicant does not wish to be bound by theory or speculation, but believes that the following explanation will add to a proper understanding of the invention. The Inventors have identified a factor aggravating the problem causing the head to get stuck against an obstacle transverse to the submerged surface, especially a wall extending substantially normal to the submerged surface over a corner having a radius of curvature smaller than a radius of curvature of the drive wheels, namely that thrust operating in known pool cleaners along a thrust line having components in the direction of motion and also toward a submerged surface, which thrust urges the head obliquely forward and against the submerged surface, i.e. into the corner described above. Over and above identifying the above factor aggravating the basic problem the Inventors are proposing a solution to the problem in principle. The Inventors have realized, to clear the obstacle, the component of thrust caused by the jet stream toward the submerged surface has to be overcome. In addition, sufficient traction has to be obtained between the drive wheels and the obstacle wall to cause the drive wheels to "climb" the obstacle wall. The Inventors propose to change the thrust line to decrease or eliminate its component toward the submerged surface and also to increase the component of thrust decumbent with the submerged surface and normal to the obstacle wall. Thus, the Inventors propose that the orientation of the first jet stream line and the first thrust line will continue to cause a bias urging the head toward the submerged surface to enhance traction of the drive wheels on the submerged surface during normal forward motion of the pool head. Furthermore, the Inventors adjust the orientation of the first jet stream line and the first thrust line, only when an obstacle is encountered, to bring about the conditions explained above, namely to decrease or eliminate the bias urging the head toward the submerged surface and also to increase the component of thrust normal to the obstacle wall.

When the pool cleaner includes a tiltable guide for the jet stream, the method may include tilting the guide about a generally transverse pitch axis to adjust the direction of guiding from the first jet stream line to the second jet stream line when the head is checked against an obstacle. The guide may be a composite guide having laterally spaced guide formations and the guide may be laterally movable relative to the thrust nozzle to change the relative proportion of impingement of the jet stream on the respective guide formations, the method then including subjecting the guide to prevailing conditions to dictate a lateral position of the guide and thus the relative proportion of impingement of the jet stream on the guide formations. The guide may be hinged to the body about a longitudinal roll axis remote from the guide. Hinging may preferably be limited to hinging about a central condition through small angles. Such imbalanced impingement creates a directional bias to steer the cleaner head to the left or to the right of a straight line.

The guide may be mounted via a surface member having a surface exposed to flow of water on account of motion of the head through the water, the method then including maintaining the surface, on account of pressure of the flow of water against the surface, in a first position against a bias while the head is moving, and tilting the guide by means of the bias when the pressure of the flow of water against the surface ceases.

The method may include redirecting the jet stream from the second jet stream line to the first jet stream line when rotation of the head about the drive wheel axis reaches a predetermined limit. Redirecting the jet stream may be effected by returning the guide by means of an abutment formation connected to the guide, on abutment of the submerged surface by the abutment formation, toward its first orientation.

In accordance with a second aspect of this invention, there is provided a pool cleaner of the pressure kind, which pool cleaner includes

- a cleaner head having at least one drive wheel rotatably mounted to the head about a lateral drive wheel axis;
- a conduit for conducting water under pressure in a flow stream to the head;
- a torque converter for converting energy of the water flow stream into mechanical energy associated with torque and being drivingly connected to said at least one drive wheel to propel the head;
- a thrust nozzle in water flow communication with said conduit for receiving a portion of the flow stream under pressure and for expelling said portion of the flow stream in a jet stream;
- a director for directing the jet stream, while the head is moving through the water, along a first jet stream line for exerting thrust on the head along a first thrust line co-incident with the first jet stream line and opposite thereto in direction, and when motion of the head through the water stops, along a second jet stream line for exerting thrust on the head along a second thrust line co-incident with the second jet stream line and opposite thereto in direction, in which the first thrust line passes the lateral drive wheel axis at a position proximate said drive wheel axis and in which the second thrust line passes the lateral drive wheel axis relatively remotely, toward a point on the periphery of said at least one drive wheel which will form an interface with the submerged surface in use.

The director may include a guide mounted to the head to confront the thrust nozzle and to be tiltable about a transverse pitch axis between a first orientation in which it directs the jet stream along the first jet stream line, and a second orientation in which it directs the jet stream along the second jet stream line, the guide being tiltable from the first orientation to the second orientation in response to the head being checked, such as against an obstacle.

The director may include a surface member which mounts the guide, the surface member being hinged to the head about said lateral pitch axis, the surface member having a surface arranged to be exposed to flow of water on account of motion of the head through the water in use to be maintained in a first position corresponding to the first orientation of the guide, and to be hinged under bias to a second position corresponding to the second orientation of the guide when motion through the water terminates.

The bias may be provided by having the nozzle directed obliquely onto the guide when the guide is in the first orientation, to cause the jet stream to impinge obliquely onto the guide thus imparting a force to the guide, in use.

By way of development, the guide may be movable laterally between limits and may have a plurality of laterally adjacent guide surfaces, a lateral position of the guide dictating a proportion of impingement of the jet stream on the respective laterally adjacent guide surfaces in use. The surface member may be hinged about a longitudinal roll axis remote from the guide, lateral movement of the guide being via hinging between limits through a roll angle about the remote, longitudinal hinge.

Hinging about the lateral pitch axis may be by means of an integral hinge in the form of a flat hinge member of synthetic polymeric material having a lateral hinge line. Said hinge line may be a composite hinge line, allowing hinging along one of a plurality of hinge lines, one or more of the hinge lines being oblique to said lateral hinge line.

Instead, more preferably, hinging about the lateral pitch axis may be by means of an integral, resilient hinge member having a lateral line of weakness forming said lateral pitch axis. The hinge member, being resilient, may allow hinging or pivoting about other axes as well.

Said laterally adjacent guide surfaces of the guide may be in the form of inverted channels. The inverted channels may be laterally spaced and may be separated by a longitudinal fin. The inverted channels may diverge from upstream to downstream ends thereof, and sides of the fin may diverge commensurately.

If desired, the pool cleaner may include an auxiliary director for redirecting the jet stream from the second jet stream line to the first jet stream line when rotation of the head around the lateral drive wheel axis reaches a predetermined limit, the auxiliary director including an abutment formation connected to the surface member for hinging the surface member from its second position to its first position on abutment of the abutment member against the submerged surface.

Generally, the invention extends to a method of propelling a pool cleaner of the pressure kind over a surface submerged in pool liquid by means of tractive effort between at least one drive wheel and the submerged surface, the method including

- while the pool cleaner is moving forwardly, thrusting the pool cleaner by means of jet stream thrust generated in a nozzle passing pumped pool liquid toward the submerged surface to enhance traction;
- in response to the pool cleaner's being checked in its forward motion, redirecting the thrust to increase a forward component of the thrust and to decrease a component of the thrust toward the submerged surface.

The Inventors have also identified a further problem to which prior art pool cleaners of the general kind to which this invention relates are prone. This problem stems from the requirement that the head, when submerged, is virtually neutrally buoyant. It thus treats all surfaces, regardless of orientation of the surfaces, the same. Thus, it tends to be insensitive to its own orientation and is occasionally not in an orientation relative to a submerged surface requiring to be cleaned, in which it can effectively ingest water carrying unwanted matter from said submerged surface.

The Inventors propose that, while a pool cleaner in accordance with this invention is moving through water with the guide in its first orientation, thrust is imparted to the pool cleaner along the first thrust line, at a high level, while a "centre of drag" is below the thrust line, thus imparting a moment to the pool cleaner causing it to "dive", i.e. to move in a wide arc and not in a straight line. This biases it toward a submerged surface along which it moves, and also enhances traction. Should the orientation change toward a "tail up" orientation, movement will slow down, setting into action the mechanism changing the thrust line from the first to the second orientation causing rotation of the head around the axis, as herein described. The head is thus provided with a self-correcting mechanism or tendency, promoting an advantageous "operating posture" relative to a submerged surface along which it moves. The feature described above must be perceived in conjunction with a well-known concept of balancing the cleaner head, generally involving a float toward a rear end or hose end of the head, and a weight toward a fore end or nose end of the head. In the explanation above, terms denoting direction have been used in relation to the head as if the head moves along a horizontal floor of a pool.

The invention will now be described, by way of example, with reference to the accompanying diagrammatic drawings.

Figure 1:
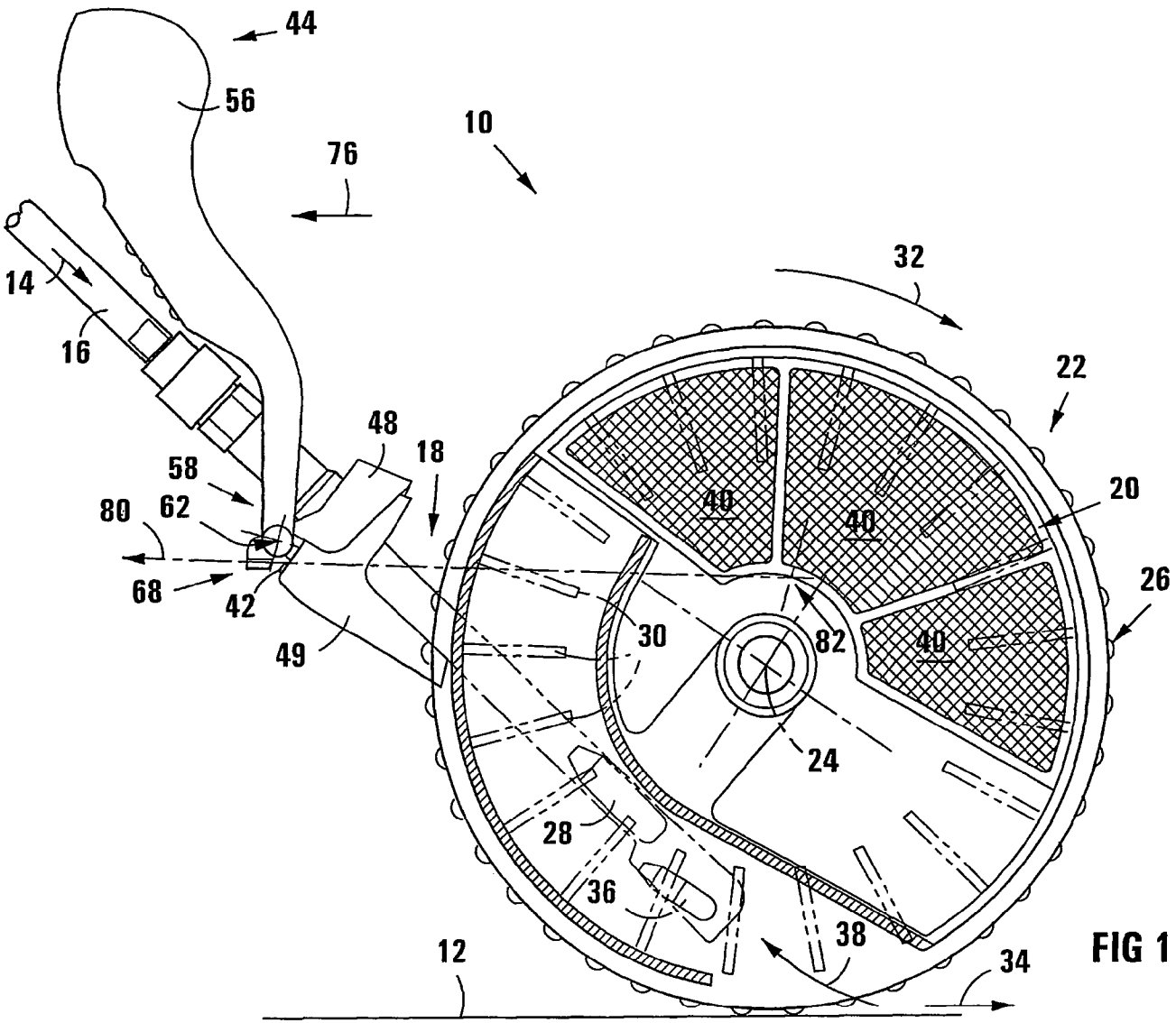
FIG. 1 shows, in part sectional side view, a pool cleaner in accordance with the invention, one wheel being removed to show the underlying structure.
Figure 2:
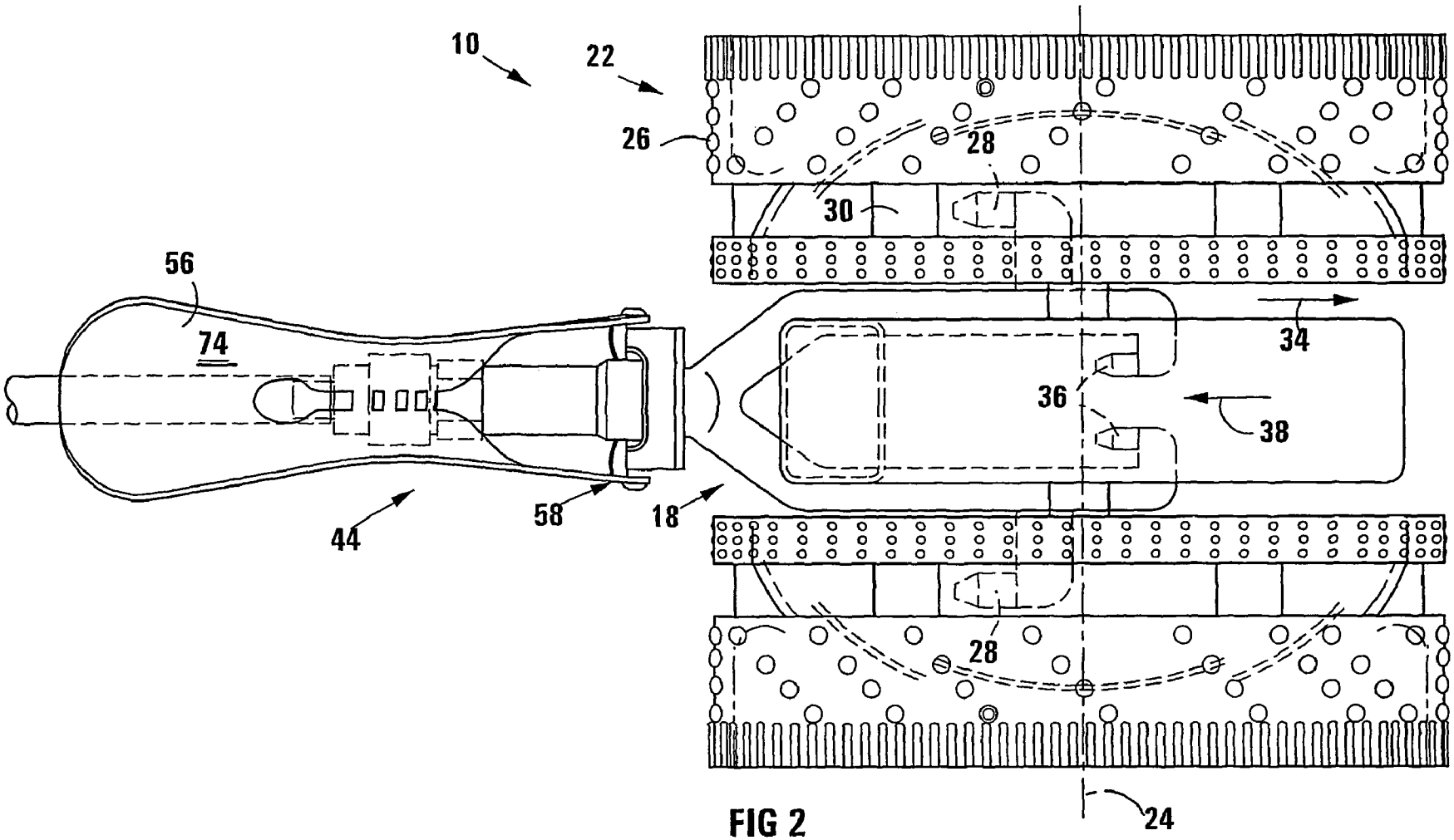
FIG. 2 shows a top plan view of the pool cleaner.

With reference to the drawings, a pool cleaner of the pressure kind in accordance with the invention comprises a pool cleaner head generally indicated by reference numeral 10 which is propelled over a submerged surface 12, for example a floor of a, swimming pool. Water is pumped in a flow stream 14 along a conduit 16 to the head 10.

The head 10 comprises a body generally indicated by reference numeral 20 and including a pair of drive wheels 22 rotatably mounted to the body 20 for rotation about a lateral drive wheel axis 24. (One of the wheels has been removed in FIG. 1 to show obscured structure). The drive wheels 22 have treads 26 of a resilient synthetic polymeric material, which treads have a coarse outer surface to enhance traction between the wheels and the submerged surface 12.

The flow stream of pumped water 14 is directed via flow passages 18 to various nozzles forming part of the pool cleaner head 10.

The nozzles of a first pair of drive nozzles 28 are positioned downstream of 180° bends in bifurcation limbs of a flow passage 18 and are directed, oppositely to the initial direction of flow of the flow stream 14, along the conduit 16, at vanes 30 on the insides of the drive wheels 22 to cause jet streams of water to impinge on the vanes 30 to drive the drive wheels 22 in a direction indicated at 32 about the axis 24 and thus to propel the head 10 over the submerged surface 12 as indicated by reference numeral 34.

A large portion of the flow stream 14 is directed to induction nozzles 36 which, similarly to the drive nozzles 28, reverse the direction of flow to cause a relatively large induction flow into a separating cavity of the body 20 to induct water from immediately above the submerged surface 12 as indicated by reference numeral 38 into the separating cavity. It is to be appreciated that undesirable matter, such as dust, leaves, and the like, is carried with the inducted water into the separating cavity. Within the body 20, in the separating cavity, the particulate matter is retained behind strainers 40 which allow strained water to return to the body of water within the pool.

A portion of water is also diverted from the flow stream 14 to a thrust nozzle 42 positioned immediately upstream of the bifurcation in the flow passages 18, The thrust nozzle 42 is orientated to direct a jet stream 46 of water generally rearwardly in a longitudinal direction in a plane which is generally perpendicular to the axis 24.

In accordance with the invention, there is provided a director, generally indicated by reference numeral 44, for directing the jet stream 46 exiting the thrust nozzle 42.

Figure 3:
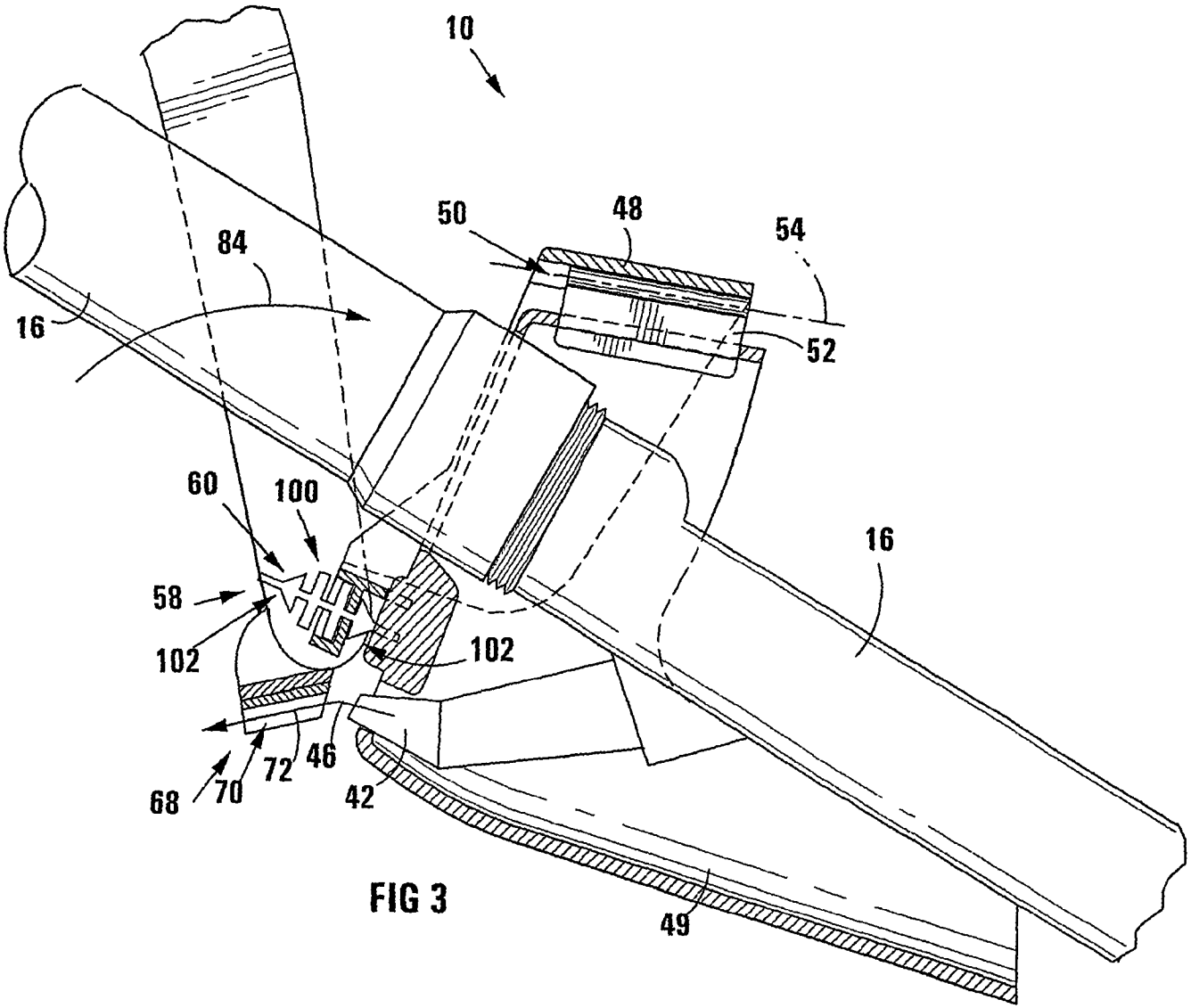
FIG. 3 shows, schematically, to an enlarged scale, a part sectional side view of a thrust nozzle and guide.

The director 44 includes a ring-like or saddle connector 48 which extends with clearance partially around the conduit 16 and is connected indirectly to the body 20 via a mount 49 which is snap-lockingly mounted on the body 20 at a fore end thereof. The connector 48 is connected to the mount 49 and hence to the body 20 by means of a hinge arrangement 50 (FIG. 3). The hinge arrangement 50 includes a first, roll, hinge member 52 which is formed of a synthetic polymeric material and defines a first, roll, hinge axis 54 which extends generally longitudinally.

The director 44 further includes a surface member 56 which is connected to the connector 48 by a second, pitch, hinge arrangement 58 (FIGS. 1 and 3). The second hinge arrangement 58 includes a second, pitch, hinge member 60 of synthetic polymeric material which defines a second, pitch, hinge axis 62 which extends transversely generally parallel with the axis 24.

Figure 6:
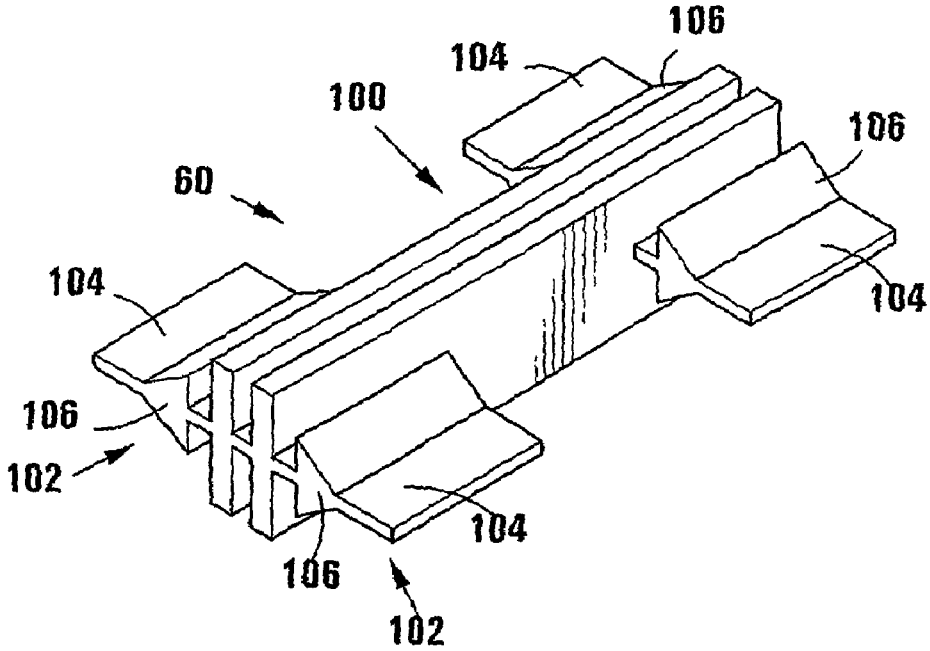
FIG. 6 shows, to an enlarged scale, a three-dimensional view of a hinge member of the pool cleaner.

The pitch hinge member 60 which is shown in FIG. 6 of the drawings, is resiliently flexible and includes a generally H-shaped central section 100 and four outwardly projecting locating formations 102 arranged in opposed pairs. Each locating formation 102 includes a tongue 104 and a retaining insert 106. The inserts 106 protrude from the respective tongues 104 in opposite directions. The tongues 104 on one side of the central section 100 are receivable in complementary slots in the connector 48. The tongues 104 on the other side of the central section 100 are receivable in complementary slots in the surface member 56, the inserts 106 serving to retain the tongues in position in the associated slots. To this end, the inserts 106 taper toward the free ends of the tongues 104 to facilitate their insertion into the associated slots.

The hinge members 52, 60 are configured so that relative movement between the connector 48 and the body 20 as well as between the surface member 56 and the connector 48 is primarily about the first, roll, axis 54 and the second, pitch, axis 62 respectively. However, the hinge members 52, 60 may be sufficiently flexible to permit elastic deformation thereof and thereby to permit limited movement among the connector 48, body 20 and surface member 56 other than about the axes 54, 62.

As mentioned above, the connector 48 extends with clearance around the conduit 16. A recess (not shown) is provided in an edge of the connector 48 at a position diametrically opposite to the hinge arrangement 50. A stop 66 is provided on the mount 49 and positioned in the recess to limit the degree of pivoting of the connector 48 about the first hinge axis 54, ie in the direction of arrow 55 (FIG. 5).

Figure 5:
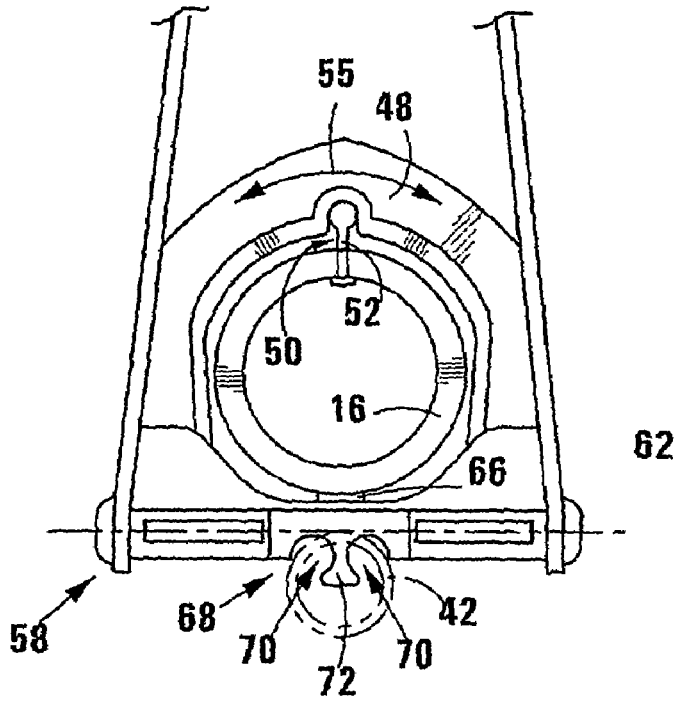
FIG. 5 shows, to an enlarged scale, a sectional view taken at V-V in FIG. 4.

With reference especially to FIGS. 1, 3 and 5, a guide 68 is provided on the surface member 56 at a fore, lower end thereof. The guide 68 defines a pair of laterally spaced inverted channels 70, of semi-circular section and of short length. The channels 70 diverge away from leading ends thereof and are separated by a fin 72. The width of the fin increases rearwardly, ie away from the nozzle 42, and commensurately with divergence of the channels 70.

The surface member 56 defines a relatively large surface 74 which is exposed (sail fashion or air-brake fashion) to water flow, generally indicated by reference numeral 76, when the head 10 moves forward in the direction 34. It is to be appreciated that the surface 74 is in fact moved through the water which is generally stationary, but relative flow takes place applying a force in the direction 76 on the surface 74. Such force is transferred by lever action to the guide 68 to maintain the guide 68, against a bias described below, in its orientation which is its first orientation as shown in FIG. 1.

In this orientation, the guide 68 serves to deflect water from the thrust nozzle 42 as shown at 46 in FIG. 1, causing thrust to be imparted to the head 10 along a first line 80. It is important to appreciate, as shown in FIG. 1, that the first thrust line 80 passes above the lateral drive wheel axis 24 as indicated by reference numeral 82.

It will be appreciated that the flow of water exiting the thrust nozzle 42 impinges on the guide 68 where the water enters the channels 70 and the guide 68 (and with it the surface member 56) is deflected or biassed generally about axis 62. In addition, the provision of the fin 72 and channels 70 serves to split the flow into two streams which are directed obliquely outwardly at small angles. Provided that equal volumes of water flow in each of the channels 70 the lateral components of thrust of the water flowing in the channels 70 are balanced so that the net thrust is along the first thrust line 80.

If, however, the director 44 is displaced about the first, roll, hinge axis 54 then the guide 68 will be displaced (by being pivoted) laterally between limits, relative to the thrust nozzle 42 so that a greater volume of water flows through one of the channels 70. This results in the lateral components of thrust being uneven with a net lateral component of thrust being applied to the body 20 which results in a steering action causing the body to turn left or right as the case may be.

Figure 4:
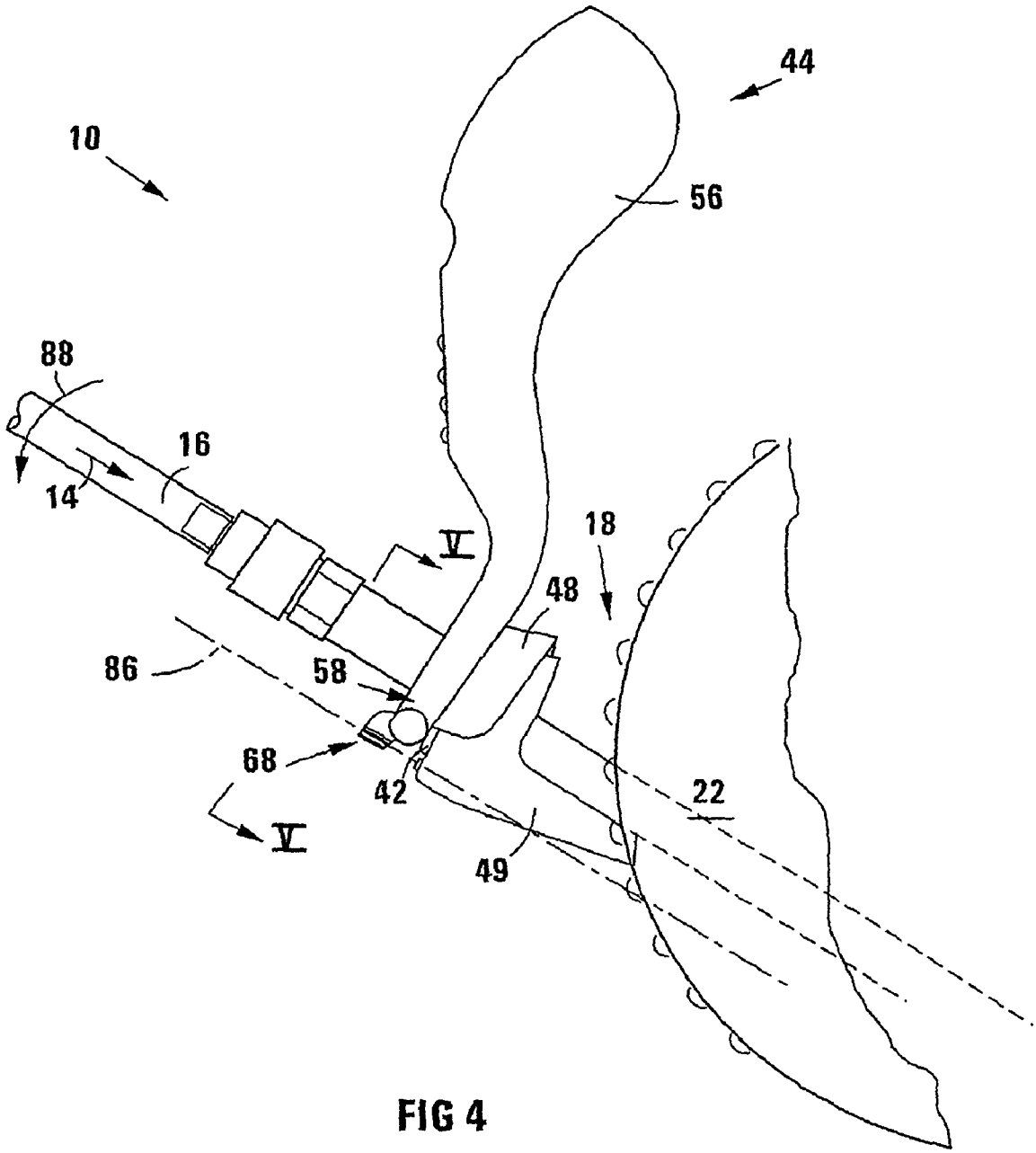
FIG. 4 shows, in a fragmentary view to an enlarged scale, corresponding to FIG. 1, the pool cleaner when it has been stopped against an obstacle.

Naturally, the water from the thrust nozzle 42 impinging on the guide 68 biasses the director 44 in the direction of arrow 84 (FIG. 3). This is balanced by the force of water acting on the surface member 56 thereby retaining the director 44 in the position shown in FIG. 1 of the drawings. In the event that forward motion in the direction of arrow 34 of the head 10 is halted or checked, more specifically by means of an obstacle such as a wall transverse to the direction of forward motion 34, the relative water flow 76 against the surface 74 terminates and thus the force maintaining the position of the guide 68 against the bias of the jet stream 46 mentioned above also terminates. Consequently, the director 44 tilts forward under the bias and in the direction of the bias as shown at 84. Thus, orientation of the guide 68 changes from the orientation shown in FIG. 1 and which orientation establishes the orientation of the first thrust line 80, to a second orientation shown in FIG. 4. Thus, the jet stream causes a thrust to be applied to the pool cleaner 10 along a second thrust line 86. The second thrust line 86 extends in a direction which causes it to pass remotely from the lateral drive wheel axis 24, ie close to an interface between the tread 26 and the submerged surface 12. Such thrust thus causes a moment about the axis 24 as shown at 88, which causes the conduit 16 and all of its attachments to rotate about the axis 24 and thus to close onto the surface 12. The thrust line 86 then extends generally parallel to the surface 12 and close to, even very close to, the surface 12. As a result, the head 10 is no longer thrust into a corner, or is no longer thrust to the same degree into the corner, formed between the surface 12 and the obstacle wall. A component of the thrust (i.e. the component of thrust normal to, and toward, the surface 12) opposite to the direction in which the head 10 must move along the obstacle wall is not present or is greatly reduced. Furthermore, the component of force forcing the drive wheels 22 against the obstacle wall is increased, thus increasing the traction of the treads 26 on the obstacle wall and causing the drive wheels 22 to climb along the obstacle wall and thus to take the head 10 out of the corner.

In addition, as mentioned above, should the director 44 be deflected about the first, roll, hinge axis 54, eg as a result of the head coming into contact with an inclined surface, eg a wall of the pool, the first thrust line 80 will be deflected laterally and will tend to bias the head 10 either left or right, depending upon the direction of displacement of the guide 68. The Applicant believes that this is an advantageous way of introducing further possibilities of movement which can be executed by the head.

The Applicant believes that this invention provides an elegant, and simple method and device for alleviating or solving the problems described at the onset of this specification, namely that pool cleaners of the kind to which the invention relates are prone to becoming stuck in corners in submerged surfaces along which the pool cleaners move and obstacle walls. In addition, the lateral thrust arising as a result of pivoting of the guide 68 about the axis 54 causes the head to deviate from a straight line leading to improved cover of the surface 12. It is also regarded as an advantage that the director arrangement of the invention can be retrofitted, with relatively small modification to existing pool cleaners of the kind described.

The invention claimed is:

1. A method of propelling a pool cleaner of the pressure kind over a submerged surface, the method including pumping water in a flow stream to a pool cleaner head;

converting energy of the pumped flow stream into mechanical energy associated with torque and applying said torque to at least one drive wheel, mounted to the head about a lateral wheel axis, to propel the head in a forward direction;

directing a portion of the pumped flow stream via a thrust nozzle mounted on the head in a jet stream generally along a first jet stream line to generate thrust generally along a first thrust line co-incident with said first jet stream line and in opposite direction;

in response to the head being checked against an obstacle transverse to said submerged surface, redirecting the jet stream along a second jet stream line to redirect thrust along a second thrust line co-incident with said second jet stream line and in opposite direction thereto, such as to cause the head to rotate about said lateral wheel axis relative to the submerged surface.

2. A method as claimed in claim 1 in which the first jet stream line and the first thrust line are oriented to intersect or to pass proximate the drive wheel axis, the second jet stream line and the second thrust line being oriented to pass the drive wheel axis remotely on the side of the submerged surface.

3. A method as claimed in claim 2 in which the second thrust line passes proximate an interface between the or each drive wheel and said submerged surface.

4. A method as claimed in claim 1 in which the pool cleaner includes a tiltable guide for the jet stream, the method including tilting the guide about a generally transverse pitch axis to adjust the direction of guiding from the first jet stream line to the second jet stream line when the head is checked against an obstacle.

5. A method as claimed in claim 4 in which the guide is a composite guide having laterally spaced guide formations and in which the guide is laterally movable relative to the thrust nozzle to change the relative proportion of impingement of the jet stream on the respective guide formations, the method including subjecting the guide to prevailing conditions to dictate a lateral position of the guide and thus the relative proportion of impingement of the jet stream on the guide formations.

6. A method as claimed in claim 5 in which the guide is hinged to the body about a longitudinal roll axis remote from the guide and being limited to hinging about a central condition through small angles.

7. A method as claimed in claim 4 in which the guide is mounted via a surface member having a surface exposed to flow of water on account of motion of the head through the water, the method including maintaining the surface, on account of pressure of the flow of water against the surface, in a first position against a bias while the head is moving, and tilting the guide by means of the bias when the pressure of the flow of water against the surface ceases.

8. A method as claimed in claim 1 which includes redirecting the jet stream from the second jet stream line to the first jet stream line when rotation of the head about the drive wheel axis reaches a predetermined limit.

9. A method as claimed in claim 8 in which redirecting the jet stream is effected by returning the guide by means of an abutment formation connected to the guide, on abutment of the submerged surface by the abutment formation, toward its first orientation.

10. A pool cleaner of the pressure kind, which pool cleaner includes

- a cleaner head having at least one drive wheel rotatably mounted to the head about a lateral drive wheel axis;
- a conduit for conducting water under pressure in a flow stream to the head;
- a torque converter for converting energy of the water flow stream into mechanical energy associated with torque and being drivingly connected to said at least one drive wheel to propel the head;
- a thrust nozzle in water flow communication with said conduit for receiving a portion of the flow stream under pressure and for expelling said portion of the flow stream in a jet stream;
- a director for directing the jet stream, while the head is moving through the water, along a first jet stream line for exerting thrust on the head along a first thrust line co-incident with the first jet stream line and opposite thereto in direction, and when motion of the head through the water stops, along a second jet stream line for exerting thrust on the head along a second thrust line co-incident with the second jet stream line and opposite thereto in direction, in which the first thrust line passes the lateral drive wheel axis at a position proximate said drive wheel axis and in which the second thrust line passes the lateral drive wheel axis relatively remotely, toward a point on the periphery of said at least one drive wheel which will form an interface with the submerged surface in use.

11. A pool cleaner as claimed in claim 10 in which the director includes a guide mounted to the head to confront the thrust nozzle and to be tiltable about a transverse pitch axis between a first orientation in which it directs the jet stream along the first jet stream line, and a second orientation in which it directs the jet stream along the second jet stream line, the guide being tiltable from the first orientation to the second orientation in response to the head being checked, such as against an obstacle.

12. A pool cleaner as claimed in claim 11 in which the director includes a surface member which mounts the guide, the surface member being hinged to the head about said lateral pitch axis, the surface member having a surface arranged to be exposed to flow of water on account of motion of the head through the water in use to be maintained in a first position corresponding to the first orientation of the guide, and to be hinged under bias to a second position corresponding to the second orientation of the guide when motion through the water terminates.

13. A pool cleaner as claimed in claim 12 in which the bias is provided by having the nozzle directed obliquely onto the guide when the guide is in the first orientation, to cause the jet stream to impinge obliquely onto the guide thus imparting a force to the guide, in use.

14. A pool cleaner as claimed in claim 12 in which the guide is movable laterally between limits and has a plurality of laterally adjacent guide surfaces, a lateral position of the guide dictating a proportion of impingement of the jet stream on the respective laterally adjacent guide surfaces in use.

15. A pool cleaner as claimed in claim 14 in which the surface member is hinged about a longitudinal roll axis remote from the guide, lateral movement of the guide being via hinging between limits through a roll angle about the remote, longitudinal hinge.

16. A pool cleaner as claimed in claim 14 in which the guide surfaces are in the form of inverted channels.

17. A pool cleaner as claimed in claim 16 in which the inverted channels are laterally spaced and are separated by a longitudinal fin.

18. A pool cleaner as claimed in claim 16 in which the inverted channels diverge from upstream to downstream ends thereof.

19. A pool cleaner as claimed in claim 12 in which said hinging about the lateral pitch axis is by means of an integral hinge in the form of a flat hinge member of synthetic polymeric material having a lateral hinge line.

20. A pool cleaner as claimed in claim 19 in which said hinge line is a composite hinge line, allowing hinging along one of a plurality of hinge lines, one or more of the hinge lines being oblique to said lateral hinge line.

21. A pool cleaner as claimed in claim 12 in which said hinging about the lateral pitch axis is by means of an integral, resilient hinge member having a lateral line of weakness forming said lateral pitch axis.

22. A pool cleaner as claimed in claim 10 which includes an auxiliary director for redirecting the jet stream from the second jet stream line to the first jet stream line when rotation of the head around the lateral drive wheel axis reaches a predetermined limit, the auxiliary director including an abutment formation connected to the surface member for hinging the surface member from its second position to its first position on abutment of the abutment member against the submerged surface.

* * * * *